US007563169B2

(12) United States Patent
Miyakawa

(10) Patent No.: US 7,563,169 B2
(45) Date of Patent: Jul. 21, 2009

(54) CONTROL LEVER DEVICE

(75) Inventor: Toshiki Miyakawa, Shibuya-ku (JP)

(73) Assignee: Namco Bandai Games Inc., Tokyo (JP)

( * ) Notice: Subject to any disclaimer, the term of this patent is extended or adjusted under 35 U.S.C. 154(b) by 604 days.

(21) Appl. No.: 10/900,277

(22) Filed: Jul. 28, 2004

(65) Prior Publication Data

US 2005/0054443 A1 Mar. 10, 2005

(30) Foreign Application Priority Data

Jul. 31, 2003 (JP) ..... 2003-283649

(51) Int. Cl.
*A63F 9/24* (2006.01)
*G09G 5/00* (2006.01)

(52) U.S. Cl. ..... 463/38; 345/161; 200/61.1

(58) Field of Classification Search ..... 463/36–38, 463/57; 345/161, 184, 419, 433, 430; 700/85
See application file for complete search history.

(56) References Cited

U.S. PATENT DOCUMENTS

| | | | | |
|---|---|---|---|---|
| 4,439,649 | A * | 3/1984 | Cecchi | 200/6 A |
| 4,491,325 | A * | 1/1985 | Bersheim | 463/38 |
| 4,926,172 | A * | 5/1990 | Gorsek | 341/20 |
| 5,847,694 | A * | 12/1998 | Redford et al. | 345/158 |
| 5,868,620 | A * | 2/1999 | Wada et al. | 463/38 |
| 6,030,291 | A * | 2/2000 | Maki et al. | 463/38 |
| 6,033,309 | A * | 3/2000 | Couch et al. | 463/38 |
| 6,059,660 | A * | 5/2000 | Takada et al. | 463/38 |
| 6,162,124 | A * | 12/2000 | Hiraoka et al. | 463/38 |
| 6,251,015 | B1 * | 6/2001 | Caprai | 463/36 |
| 6,320,284 | B1 * | 11/2001 | Fontana et al. | 310/12 |
| 6,352,477 | B1 * | 3/2002 | Soma et al. | 463/36 |
| 6,531,998 | B1 * | 3/2003 | Gordon | 345/156 |
| 6,589,118 | B1 * | 7/2003 | Soma et al. | 463/38 |
| 6,859,198 | B2 * | 2/2005 | Onodera et al. | 345/161 |
| 6,904,823 | B2 * | 6/2005 | Levin et al. | 74/471 XY |
| 2003/0038781 | A1 * | 2/2003 | Hsu | 345/161 |
| 2004/0046740 | A1 * | 3/2004 | Martin et al. | 345/161 |

FOREIGN PATENT DOCUMENTS

| | | |
|---|---|---|
| DE | 3442287 A | 5/1986 |
| GB | 1 326 400 | 8/1973 |
| GB | 2 007 025 A | 5/1979 |
| JP | B2 2740145 | 1/1998 |
| WO | WO 02/093604 A1 | 11/2002 |

* cited by examiner

*Primary Examiner*—John M Hotaling, II
*Assistant Examiner*—Masud Ahmed
(74) *Attorney, Agent, or Firm*—Oliff & Berridge, PLC

(57) ABSTRACT

A control lever device includes: a control lever unit including an inner frame, a control lever supported by the inner frame in a manner to be movable about a fulcrum along a first direction, and a positioning roller attached in the inner frame and allowing the control lever to be positioned at first and second displacement positions located on a straight line by allowing an end of the control lever to pass over the positioning roller; an outer frame supporting the control lever unit so that the control lever unit is movable in a second direction intersecting the first direction at right angles; and a moving path control section controlling a moving path of the control lever. The control lever unit includes a lever position detection section detecting a position of the control lever. The outer frame includes a unit position detection section detecting movement of the control lever unit.

9 Claims, 7 Drawing Sheets

CONTROL LEVER DEVICE

Japanese Patent Application No. 2003-283649, filed on Jul. 31, 2003, is hereby incorporated by reference in its entirety.

BACKGROUND OF THE INVENTION

The present invention relates to a control lever device. More particularly, the present invention relates to a control lever device suitable for use as a gearshift lever for a driving game machine or the like.

A multi-directional control switch disclosed in Japanese Patent No. 2740145 has been known as a control lever device used for a driving game machine or the like.

This multi-directional control switch includes a lever, a lever receiving section which supports the lever and allows the lever to be tilted in a one-axis direction and an other-axis direction which intersects the one-axis direction, an automatic return means which automatically returns the tilted lever to the upright position, a fixing means which secures the lever at a tilt position in one of the one-axis direction and the other-axis direction against the returning force applied by the automatic return means, and a switching means provided corresponding to the tilt position of the lever.

In this multi-directional control switch, the lever can be tilted in the one-axis direction and the other-axis direction by using the lever receiving section. However, since the lever receiving section can be returned to the upright position merely by the automatic return means, a gearshift feeling does not occur during the lever operation, whereby the operational feeling differs from the operational feeling of an actual gearshift lever operation.

Moreover, since the automatic return means which returns the tilted lever to the upright position is indispensable, the structure becomes complicated even in the case where the lever is tilted only in one direction.

Furthermore, since the switching means is provided irrespective of the lever receiving section, it is necessary to additionally provide a switching means even in the case where the lever is tilted only in one of the one-axis direction and the other-axis direction, whereby the degree of generality is decreased.

BRIEF SUMMARY OF THE INVENTION (1) A Control Lever Device According to the Present Invention Includes:

a control lever unit which includes an inner frame, a control lever supported by the inner frame in a manner to be movable about a fulcrum along a first direction, and a positioning roller which is attached in the inner frame and allows the control lever to be positioned at a first displacement position and a second displacement position located on a straight line by allowing an end of the control lever to pass over the positioning roller;

an outer frame which supports the control lever unit so that the control lever unit is movable in a second direction which intersects the first direction at right angles; and a moving path control section which controls a moving path of the control lever, wherein the control lever unit includes a lever position detection section which detects a position of the control lever, and wherein the outer frame includes a unit position detection section which detects movement of the control lever unit.

According to the present invention, the control lever unit is formed so that the control lever can be positioned at the first displacement position and the second displacement position located on a straight line by allowing the end of the control lever supported so as to be able to move about a fulcrum along the first direction to pass over the positioning roller. Therefore, since the end of the control lever passes over the positioning roller and is positioned, a gearshift feeling occurs when shifting the control lever, whereby an excellent operational feeling can be obtained.

Moreover, the first displacement position and the second displacement position of the control lever can be detected in the control lever unit by providing the lever position detection section which detects the position of the control lever for the control lever unit. Therefore, in the case where the control lever is provided so as to be able to move about the fulcrum only in the first direction, the control lever unit can be used without additionally providing a lever position detection section. This makes it possible to easily deal with various movement directions and movement positions of the control lever, whereby the degree of general-purposeness is increased.

Furthermore, the control lever can be operated without using an automatic return means by allowing the control lever unit to be movable in the second direction which intersects the first direction at right angles along the moving path control section which controls the moving path of the control lever, whereby the structure can be simplified.

(2) With this control lever device, the control lever unit may be provided in the outer frame so that the control lever unit is movable about a fulcrum in the second direction, and may be biased toward a neutral position by a neutral position biasing section.

This configuration enables the control lever to be automatically returned to a neutral position by the neutral position biasing section when returning the control lever to a neutral position.

(3) With this control lever device, two of the positioning rollers may be arranged side by side, and the control lever may be positioned at a neutral position which is between the first and second displacement positions by positioning the end of the control lever between the positioning rollers.

This configuration enables the control lever to be positioned at the neutral position in addition to the first and second displacement positions, whereby an excellent operational feeling can be obtained and a three-stage shift operation can be easily and securely performed.

(4) With this control lever device, the moving path control section may be replaceable so that the moving path of the control lever changes.

This configuration enables the control lever to be easily and securely moved corresponding to various types of moving paths of the control lever.

DETAILED DESCRIPTION OF THE EMBODIMENT

An embodiment of the present invention is described below with reference to the drawings.

FIGS. 1 to 8 are views showing a control lever device according to an embodiment of the present invention.

Figure 8:
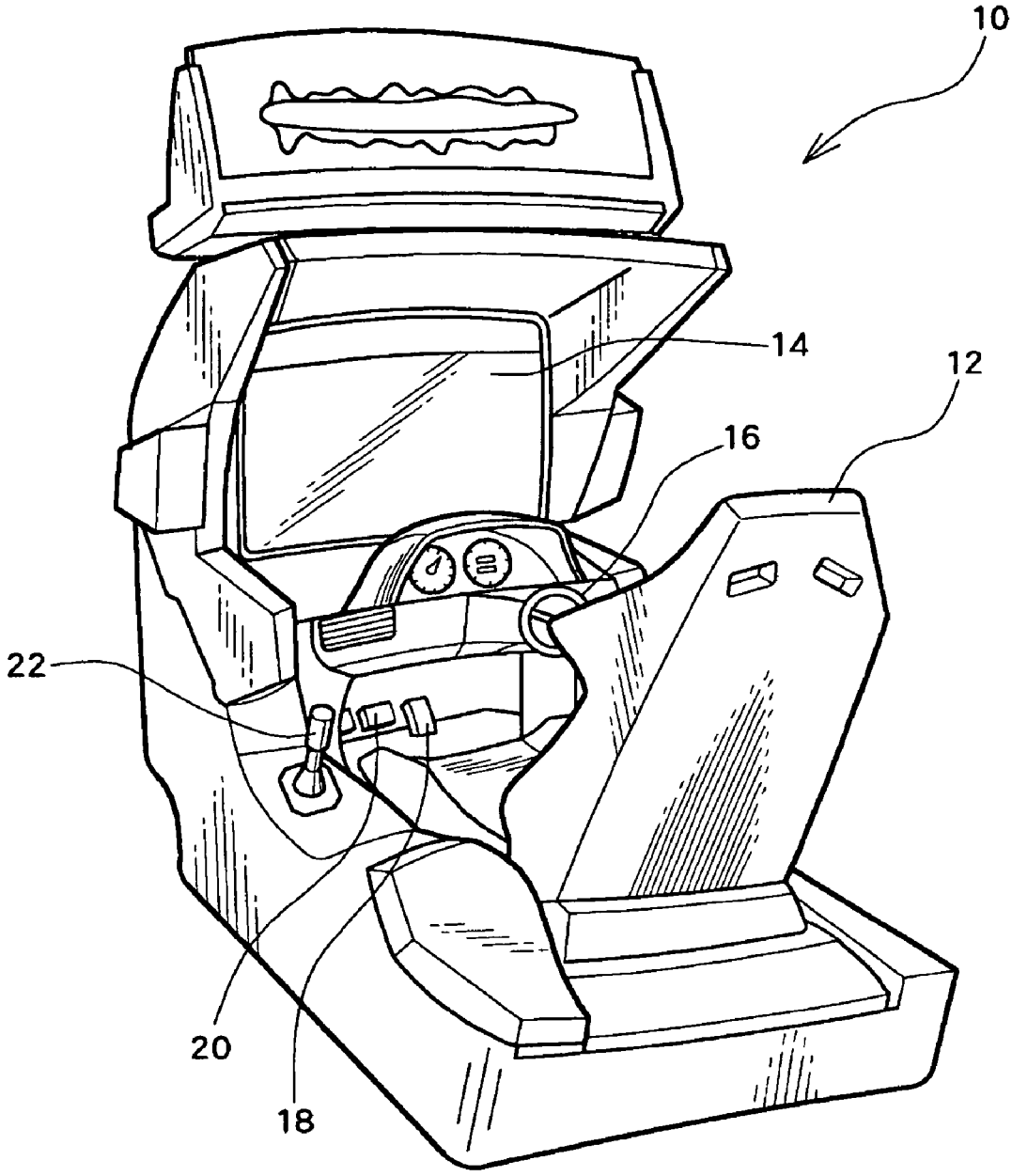
FIG. 8 is an overall oblique view of a driving game machine using a control lever device according to an embodiment of the present invention.

FIG. 8 is an oblique view showing a driving game machine using the control lever device according to the present embodiment.

A driving game machine 10 is formed so that a player drives a racing car which runs on a circuit course or a street course, and competes for ranking and time with a computer car controlled by a computer or a racing car driven by another player.

A player plays a game by operating a steering wheel 16 while seated on a seat 12 and watching a display 14, stepping on an accelerator pedal 18 or a brake pedal 20 if necessary, and operating a control lever device 22 which is a gearshift lever.

FIGS. 1 to 7 show the control lever device 22.

Figure 1:
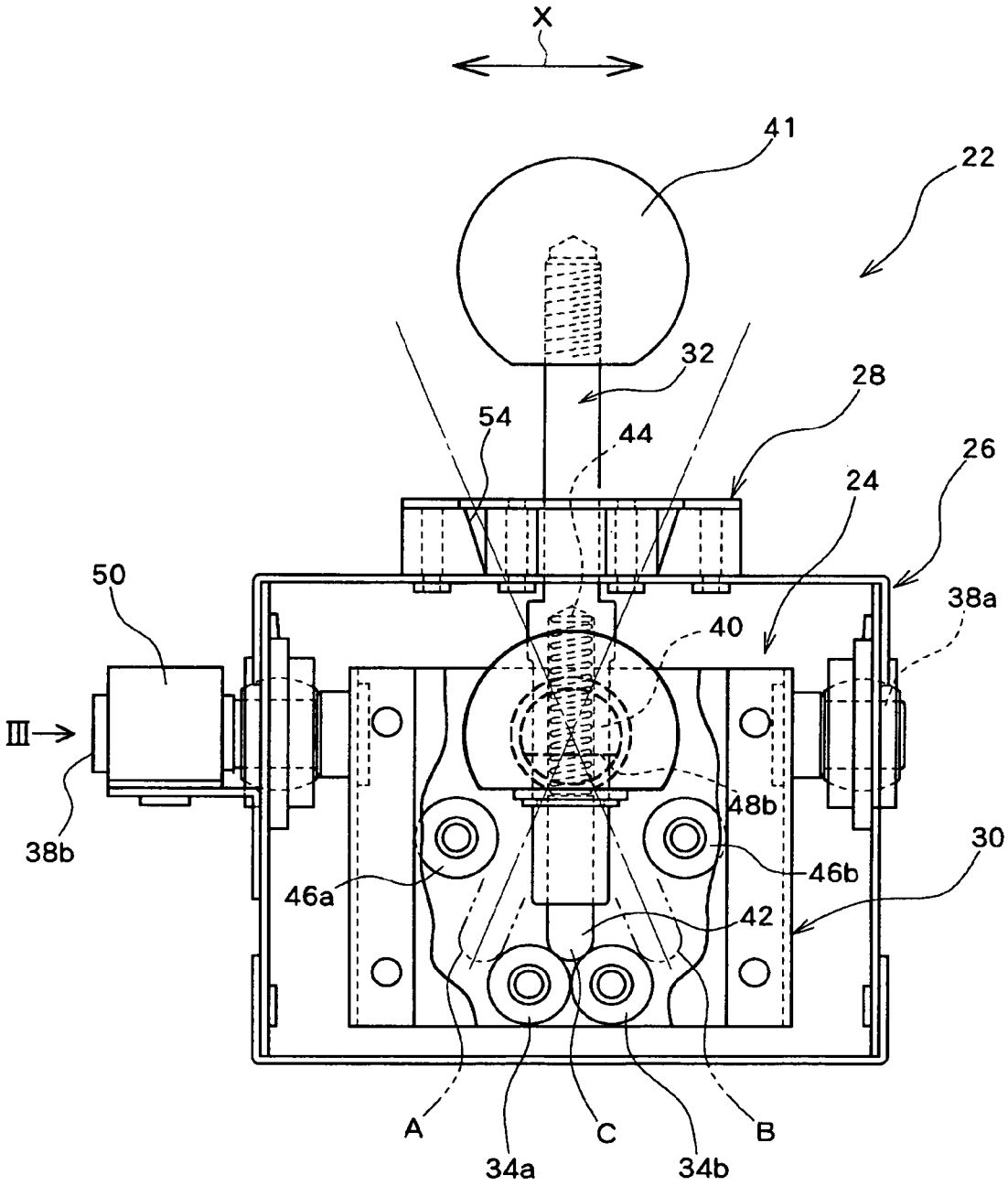
FIG. 1 is a partial cross-sectional side view of a control lever device according to an embodiment of the present invention in which a lever position detection section and a unit position detection section are omitted.
Figure 2:
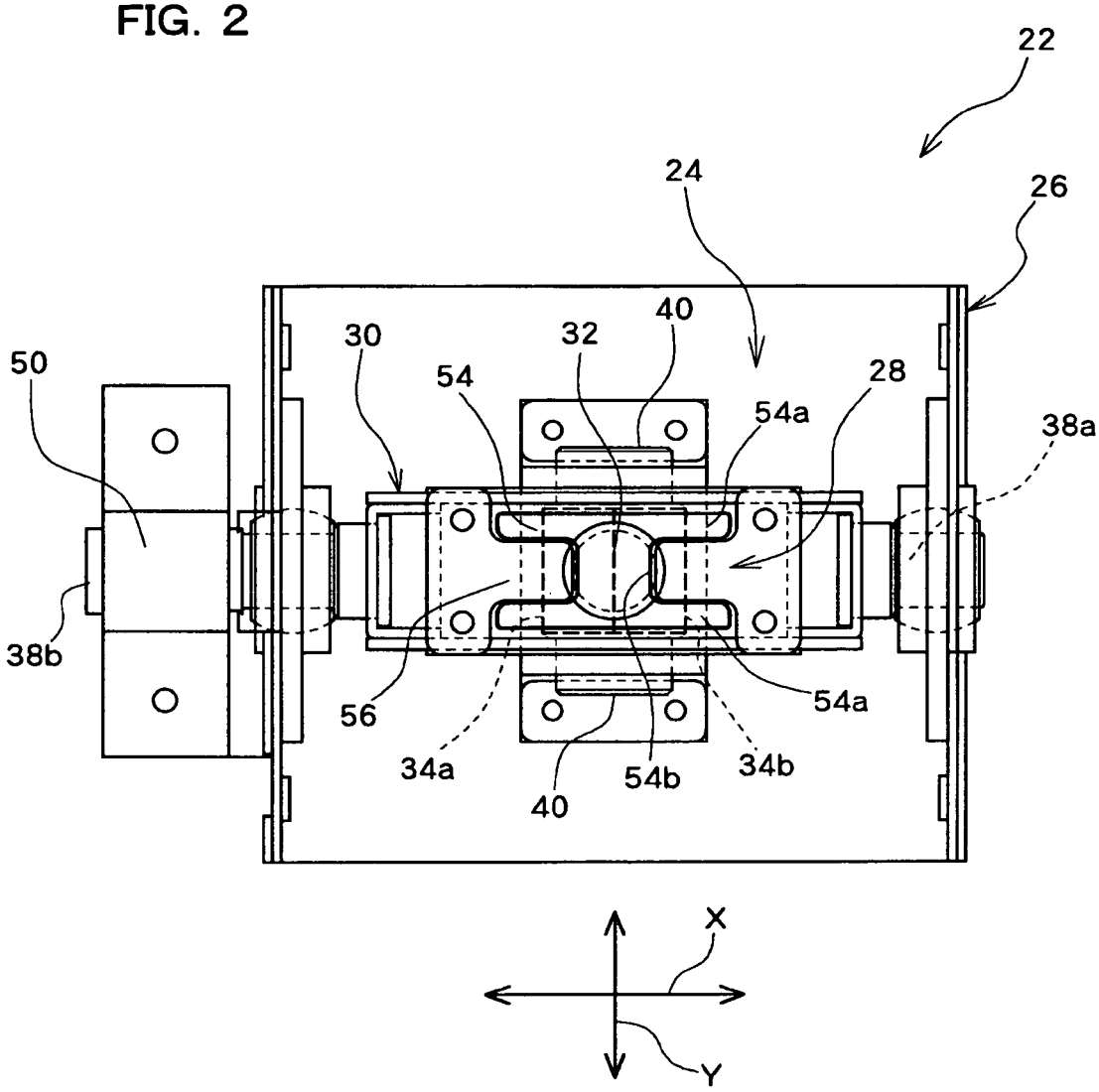
FIG. 2 is a plan view of the control lever device shown in FIG. 1.
Figure 3:
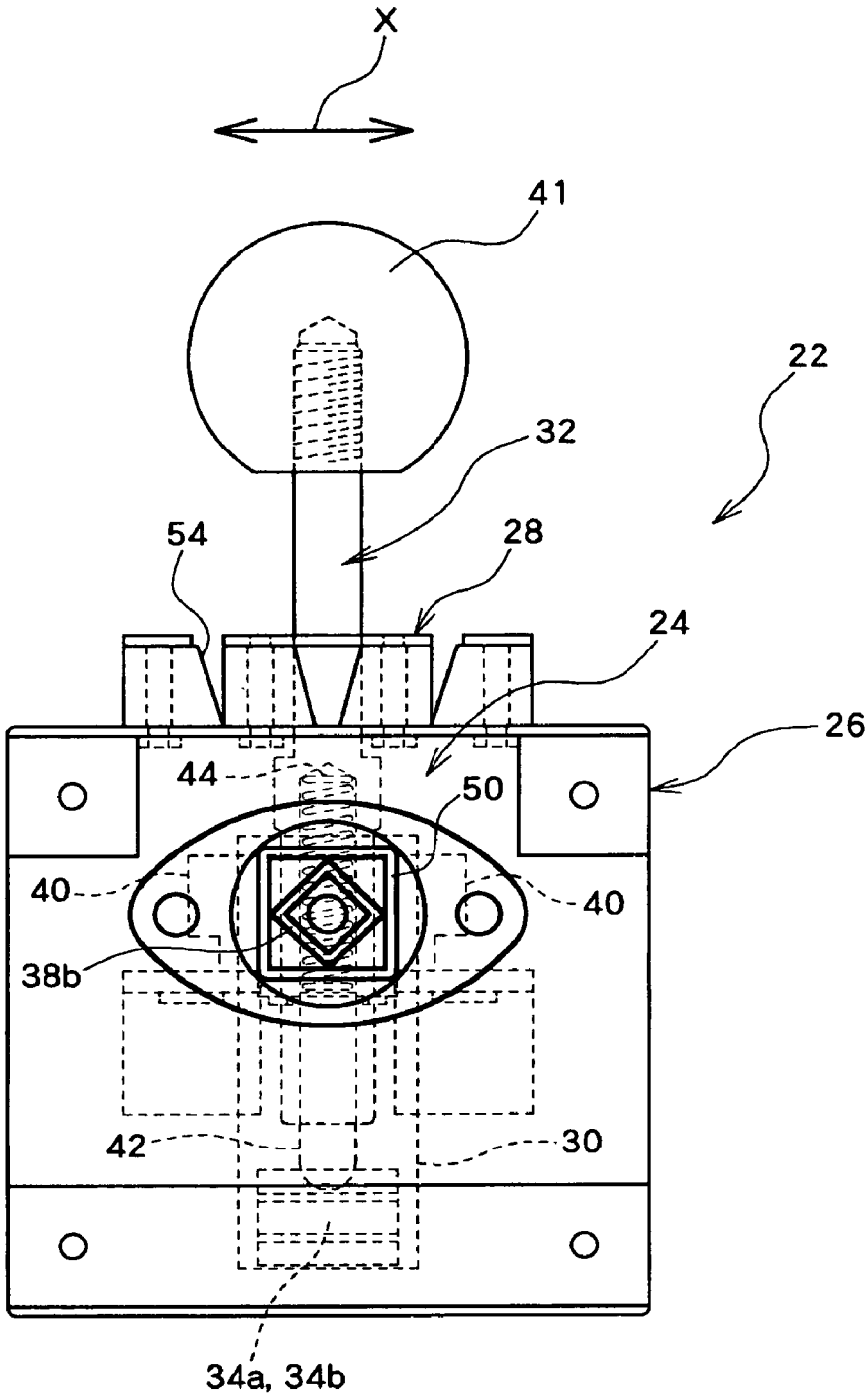
FIG. 3 is a rear view of the control lever device shown in FIG. 1 viewed in the direction of the arrow III.
Figure 4A:
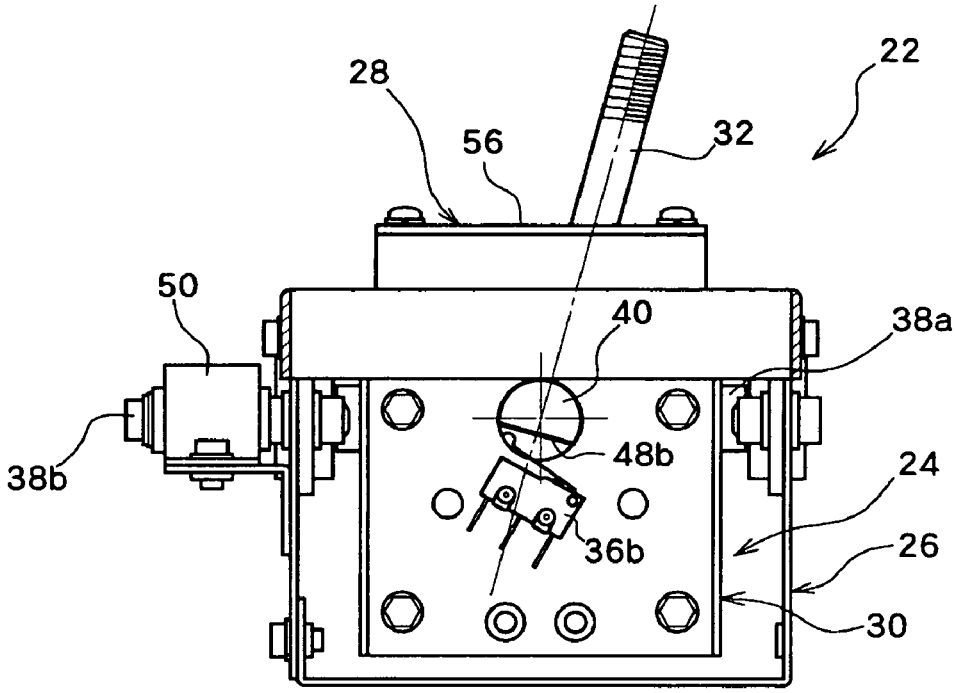
FIG. 4A is a side view showing a detection state of the lever position detection section when a control lever is pushed forward.
Figure 4B:
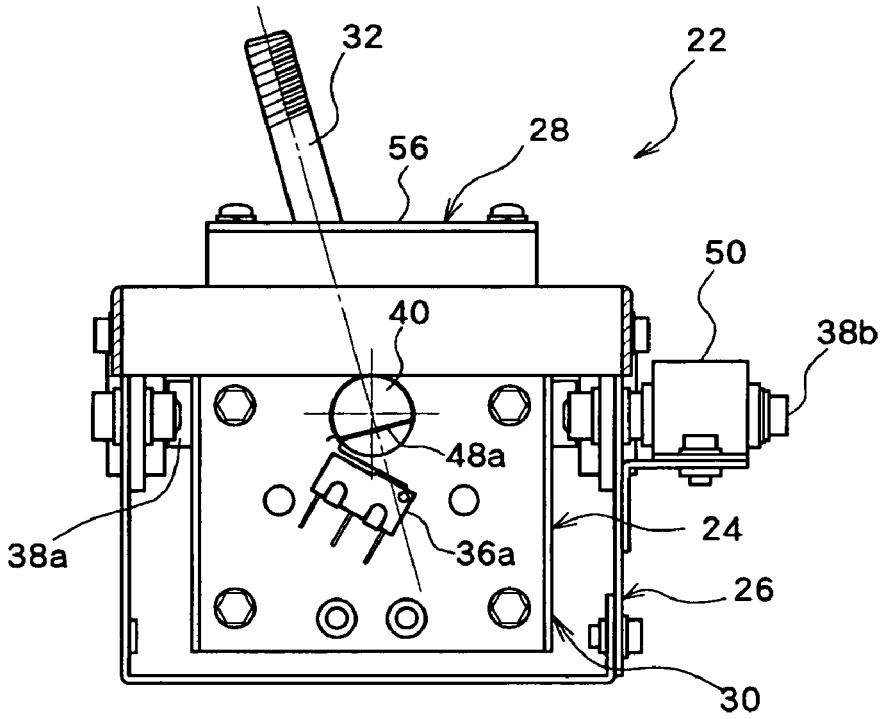
FIG. 4B is a side view viewed from the opposite side of FIG. 4A.
Figure 5A:
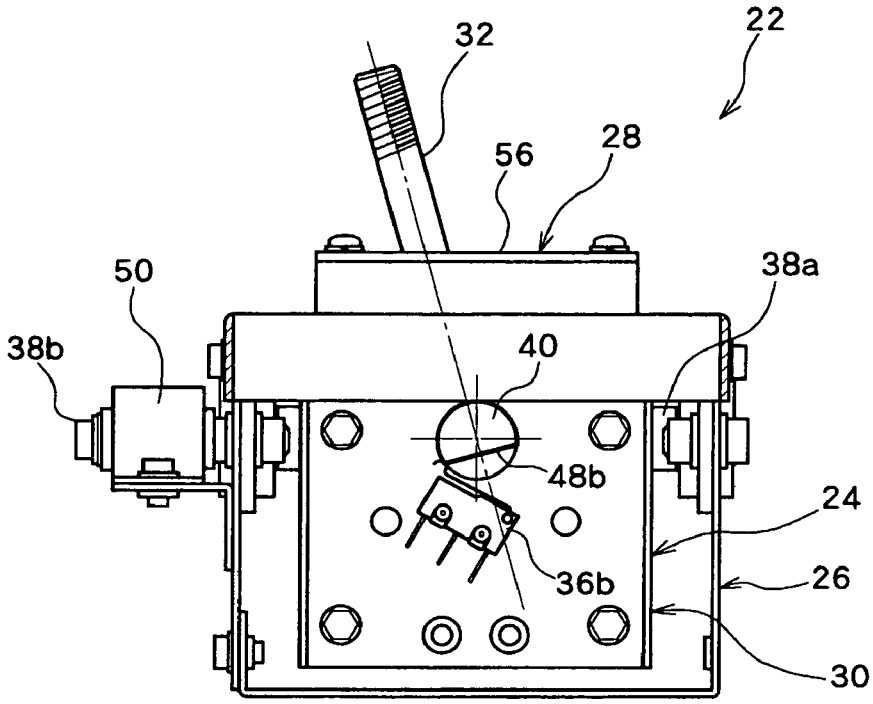
FIG. 5A is a side view showing a detection state of the lever position detection section when a control lever is pushed backward.
Figure 5B:
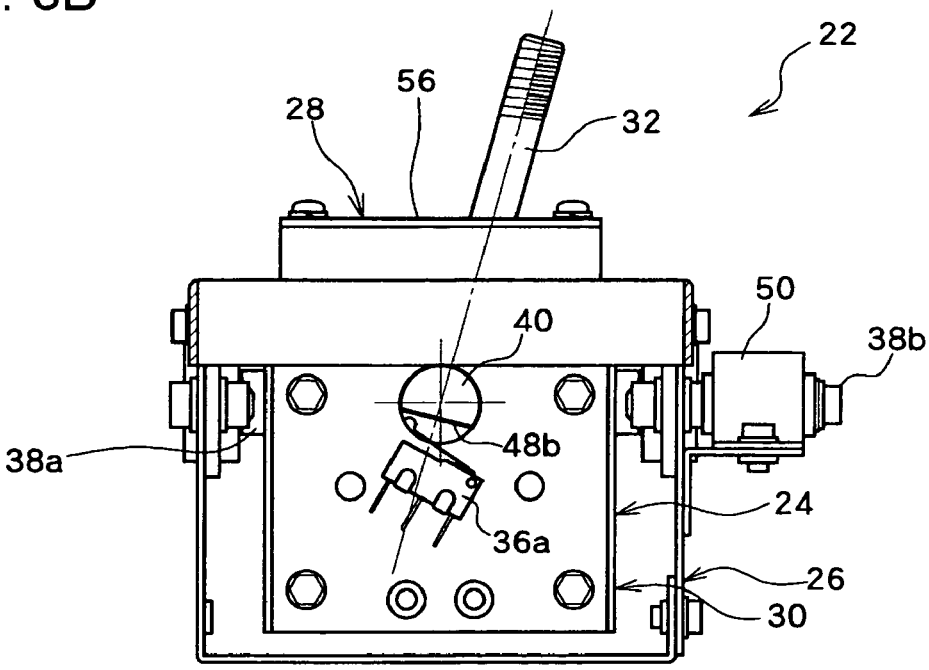
FIG. 5B is a side view viewed from the opposite side of FIG. 5A.
Figure 6:
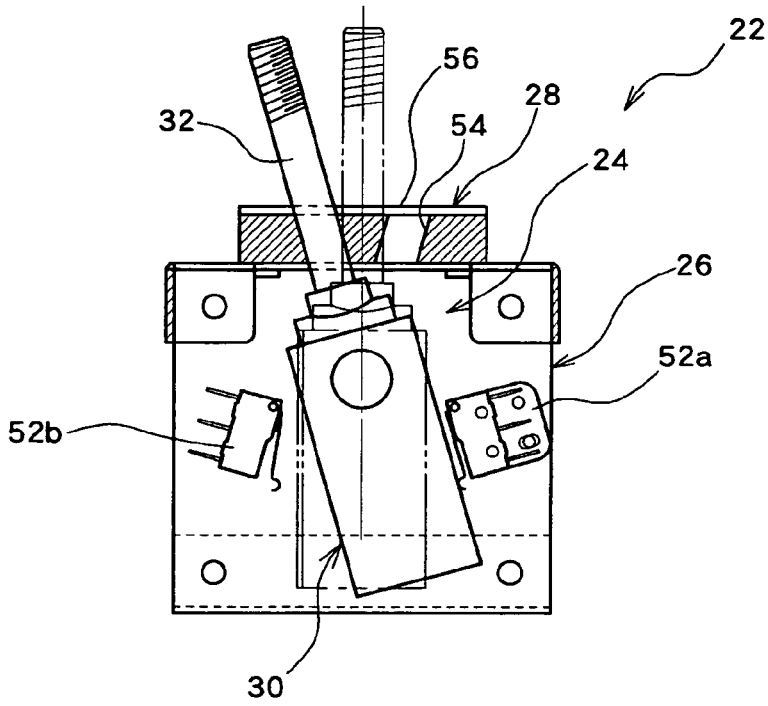
FIG. 6 is a rear view showing a state of the unit position detection section when a control lever is moved to the left.
Figure 7:
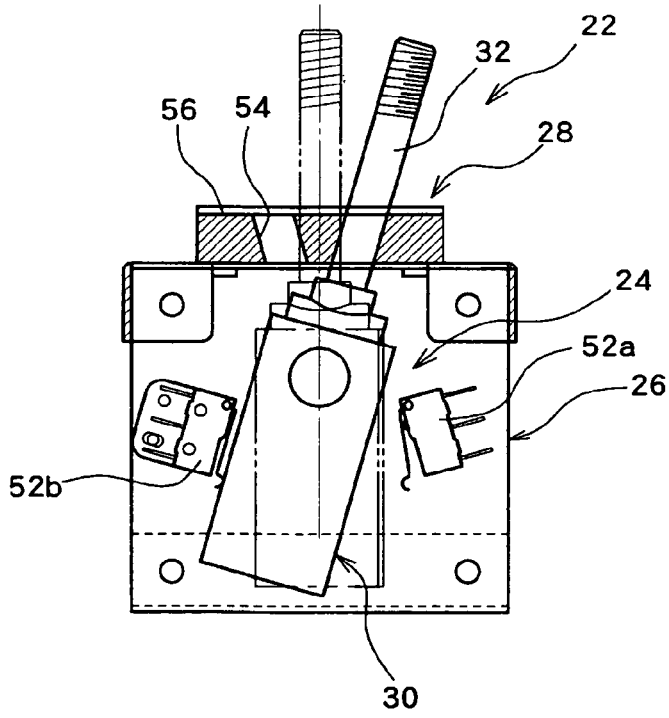
FIG. 7 is a rear view showing a state of the unit position detection section when a control lever is moved to the right.

FIG. 1 is a partial cross-sectional side view of the control lever device in which a lever position detection section and a unit position detection section are omitted; FIG. 2 is a plan view of the control lever device shown in FIG. 1; FIG. 3 is a rear view of the control lever device shown in FIG. 1 viewed in the direction of the arrow III; FIGS. 4A and 4B are side views showing the state of the lever position detection section when a control lever is pushed forward; FIGS. 5A and 5B are side views showing the state of the lever position detection section when the control lever is pulled backward; FIG. 6 is a rear view showing the state of the unit position detection section when the control lever is moved to the left; and FIG. 7 is a rear view showing the state of the unit position detection section when the control lever is moved to the right.

As shown in FIGS. 1 to 3, the control lever device 22 includes a control lever unit 24, an outer frame 26, and a moving path control section 28.

The control lever unit 24 includes an inner frame 30, a control lever 32, two positioning rollers 34*a* and 34*b*, and two lever position detection sections 36*a* and 36*b* shown in FIGS. 4A, 4B, 5A, and 5B.

The inner frame 30 is almost in the shape of a rectangular parallelepiped of which the upper and lower sides are opened. Support shafts 38*a* and 38*b* project outward from opposite side surfaces, and the support shafts 38*a* and 38*b* are rotatably supported by the outer frame 26.

The control lever 32 is attached to a rotational shaft 40 rotatably provided between the sides of the inner frame 30 in the direction which intersects the axial direction of the support shafts 38*a* and 38*b*. The control lever 32 is supported by the inner frame 30 so as to be able to move about a fulcrum along a first direction X (back-and-forth direction).

The control lever unit 24 can also move about a fulcrum in a second direction Y which intersects the first direction X at right angles by means of the support shafts 38*a* and 38*b*.

A grip 41 is attached to the upper end of the control lever 32. A plunger 42 placed inside the control lever 32 is provided at the lower end of the control lever 32 in a state in which the plunger 42 is biased by a coil spring 44 inside the control lever 32 and projects from the lower end of the control lever 32.

The positioning rollers 34*a* and 34*b* are disposed at the back-and-forth positions of the inner frame 30 in a state in which the positioning rollers 34*a* and 34*b* are adjacent to each other so as to be positioned on either side of the end position of the plunger 42 in a state in which the control lever 32 stands upright.

Therefore, the control lever 32 can be positioned at a first displacement position A at which the control lever 32 is pushed forward so that the plunger 42 at the end of the control lever 32 passes over the positioning roller 34*a* and is positioned on the left of the positioning roller 34*a*, a second displacement position B at which the control lever 32 is pulled backward so that the plunger 42 at the end of the control lever 32 passes over the positioning roller 34*b* and is positioned on the right of the positioning roller 34*b*, and a neutral position C at which the control lever 32 is made to stand upright so that the plunger 42 of the control lever 32 is positioned between the positioning rollers 34*a* and 34*b*.

A gearshift feeling occurs when shifting the control lever 32 by causing the plunger 42 at the end of the control lever 32 to be displaced so as to pass over the positioning roller 34*a* or 34*b*, whereby an excellent operational feeling can be obtained.

Stopper rollers 46*a* and 46*b* for securing the control lever 32 when the control lever 32 is positioned at the first displacement position A or the second displacement position B are provided.

As shown in FIGS. 4A, 4B, 5A, and 5B, the lever position detection sections 36*a* and 36*b* are disposed on either side of the rotational shaft 40 with the control lever 32 interposed therebetween.

The lever position detection sections 36*a* and 36*b* are formed by detection switches. Flat abutment surfaces 48*a* and 48*b* are formed by cutting the rotational shaft 40 corresponding to the lever position detection sections 36*a* and 36*b*.

In the case where the control lever 32 is pushed forward, the lever position detection section 36*b* is turned OFF as shown in FIG. 4A, and the lever position detection section 36*a* is turned ON as shown in FIG. 4B.

In the case where the control lever 32 is pulled backward, the lever position detection section 36*b* is turned ON as shown in FIG. 5A, and the lever position detection section 36*a* is turned OFF as shown in FIG. 5B.

Therefore, the lever position detection sections 36*a* and 36*b* can detect the state in which the control lever 32 is pushed forward and the state in which the control lever 32 is pulled backward.

The outer frame 26 is in the shape of a rectangular parallelepiped which covers the control lever unit 24 in a state in which the upper part of the control lever 32 projects upward. A screw rubber spring 50 is attached to the outer side surface at a position corresponding to the support shaft 38*b*. The screw rubber spring 50 biases the control lever unit 24 toward the neutral position through the support shaft 38*b*.

As shown in FIGS. 6 and 7, unit position detection sections 52*a* and 52*b* which detect the movement of the control lever unit 24 are provided in the outer frame 26 at positions facing either side of the inner frame 30.

The unit position detection sections 52*a* and 52*b* are formed by detection switches. The unit position detection section 52*a* is turned ON and the unit position detection section 52*b* is turned OFF when the control lever 32 is moved to the left as shown in FIG. 6, and the unit position detection section 52*a* is turned OFF and the unit position detection section 52*b* is turned ON when the control lever 32 is moved to the right as shown in FIG. 7 to detect the moving position.

The movement of the control lever 32 in the back-and-forth direction and the right-and-left direction can be securely detected by detecting displacement of the control lever 32 in the back-and-forth direction by using the lever position detection sections 36*a* and 36*b* and detecting displacement of the control lever 32 in the right-and-left direction by using the unit position detection sections 52*a* and 52*b*.

Since the lever position detection sections 36*a* and 36*b* are incorporated into the control lever unit 24, the control lever unit 24 can be independently used in the case where it suffices that the control lever 32 be moved only in the back-and-forth direction, whereby the degree of generality can be increased.

The moving path control section 28 controls the moving path of the control lever 32. In the present embodiment, as shown in FIG. 2, the control lever 32 can be shifted in four stages by attaching a moving path control plate 56 which includes a control lever guide groove 54 in the shape of the letter H consisting of two parallel back-and-forth direction grooves 54*a* extending in the back-and-forth direction on the upper surface of the outer frame 26 and an intermediate coupling groove 54*b* which couples the back-and-forth direction grooves 54*a*.

The control lever 32 can be stopped at a forward position or a backward position in the back-and-forth direction groove 54*a* on the right or left by using the moving path control section 28 by moving the control lever 32 to the control lever guide groove 54 on the right or left through the intermediate coupling groove 54*b* and positioning the control lever 32 at the first displacement position A or the second displacement position B using the back-and-forth direction groove 54*a*.

When the control lever 32 in this state is returned to the neutral position C, the control lever 32 moves to the position of the intermediate coupling groove 54*b* and is automatically returned to the neutral position by the biasing force applied by the screw rubber spring 50, whereby a state close to an operational feeling of an actual gearshift lever can be obtained.

Although not shown in the drawings, the moving path control section 28 can be exchanged corresponding to the moving path of various types of control levers 32.

In the case of obtaining the moving path of a six-speed control lever instead of the four-speed control lever, it is possible to deal with such a case without adding a change to the internal structure by replacing the moving path control section 28 with a moving path control section in which three parallel back-and-forth direction grooves extending in the back-and-forth direction are coupled by an intermediate coupling groove.

The present invention is not limited to the above-described embodiment. Various modifications and variations are possible within the spirit and scope of the present invention.

In the above-described embodiment, the control lever device is used for a driving game machine. However, the control lever device may be employed for a driving simulator or the like insofar as a plurality of multi-directional shift operations are necessary.

In the above-described embodiment, the control lever can be positioned at the first displacement position, the second displacement position, and the neutral position between the first displacement position and the second displacement position by using two positioning rollers. However, the control lever may be positioned only at the first displacement position and the second displacement position by using one positioning roller.

In the above-described embodiment, a screw rubber spring is used as the neutral position biasing section which biases the control lever unit toward a neutral position. However, the control lever unit may be biased toward a neutral position by disposing a coil spring between the outer frame and the inner frame.

Two unit position detection sections are used in the above-described embodiment. However, one of the unit position detection sections may be omitted by setting the neutral position of the control lever unit at one of the back-and-forth direction grooves.

The lever position detection section and the unit position detection section are formed by switches. However, the present invention is not limited thereto. The lever position detection section and the unit position detection section may be formed by a rotary encoder, a photosensor, or the like.

What is claimed is:

1. A control lever device comprising:

a control lever unit which includes an inner frame, a control lever supported by the inner frame in a manner to be movable about a fulcrum along a first direction, and a positioning roller which is attached in the inner frame and allows the control lever to be positioned at a first displacement position and a second displacement position located on a straight line by allowing an end of the control lever to pass over the positioning roller;

an outer frame which supports the control lever unit so that the control lever unit is movable in a second direction which intersects the first direction at right angles; and a moving path control section which controls a moving path of the control lever, wherein the control lever unit includes a lever position detection section which detects a position of the control lever in the inner frame, and wherein the outer frame includes a unit position detection section which detects movement of the control lever unit in the outer frame.

2. The control lever device as defined in claim 1, wherein the control lever unit is provided in the outer frame so that the control lever unit is movable about a fulcrum in the second direction, and is biased toward a neutral position by a neutral position biasing section.

3. The control lever device as defined in claim 1, wherein two of the positioning rollers are arranged side by side, and wherein the control lever is positioned at a neutral position which is between the first and second displacement positions by positioning the end of the control lever between the positioning rollers.

4. The control lever device as defined in claim 2, wherein two of the positioning rollers are arranged side by side, and wherein the control lever is positioned at a neutral position which is between the first and second displacement positions by positioning the end of the control lever between the positioning rollers.

5. The control lever device as defined in claim 1, wherein the moving path control section is replaceable so that the moving path of the control lever changes.

6. The control lever device as defined in claim 2, wherein the moving path control section is replaceable so that the moving path of the control lever changes.

7. The control lever device as defined in claim 3, wherein the moving path control section is replaceable so that the moving path of the control lever changes.

8. The control lever device as defined in claim 4, wherein the moving path control section is replaceable so that the moving path of the control lever changes.

9. A control lever device comprising:

a control lever unit which includes an inner frame, a control lever supported by the inner frame in a manner to be movable about a fulcrum along a first direction, and a positioning roller which is attached in the inner frame and allows the control lever to be positioned at a first displacement position and a second displacement position located on a straight line by allowing an end of the control lever to pass over the positioning roller;

an outer frame which supports the control lever unit so that the control lever unit is movable in a second direction which intersects the first direction at right angles; and a moving path control section which controls a moving path of the control lever, wherein the control lever unit includes a lever position detection section which detects a position of the control lever, wherein the outer frame includes a unit position detection section which detects movement of the control lever unit, and wherein the movement of the control lever in the second direction is detected by detecting the movement of the control lever unit in the second direction by using the unit position detection sections.

* * * * *